United States Patent [19]

Hirata

[11] Patent Number: 4,542,273

[45] Date of Patent: Sep. 17, 1985

[54] CIRCUIT FOR INDUCTIVE HEATING APPARATUS WITH MULTIPLE HIGH FREQUENCY ENERGY SOURCES

[75] Inventor: Hidetoshi Hirata, Nagoya, Japan

[73] Assignee: Tokyo Shibaura Denki Kabushiki Kaisha, Kawasaki, Japan

[21] Appl. No.: 566,783

[22] Filed: Dec. 29, 1983

[30] Foreign Application Priority Data

Jan. 28, 1983 [JP] Japan ..... 58-12515

[51] Int. Cl.[4] ..... H05B 6/06

[52] U.S. Cl. ..... 219/10.77; 219/10.49 R; 323/267

[58] Field of Search ..... 323/267, 268, 269; 219/10.77, 10.49 R

[56] References Cited

U.S. PATENT DOCUMENTS

| | | | |
|---|---|---|---|
| 3,543,139 | 11/1970 | Greene | 323/267 X |
| 3,560,837 | 2/1971 | Gately | 323/267 X |
| 3,925,633 | 12/1975 | Partridge . | |
| 4,085,300 | 4/1978 | MacKenzie et al. | 219/10.49 R |
| 4,092,510 | 5/1978 | Kiuchi et al. | 219/10.49 R |
| 4,115,676 | 9/1978 | Higuchi et al. . | |
| 4,189,670 | 2/1980 | Tanahashi | 323/267 |
| 4,308,443 | 12/1981 | Tucker et al. | 219/10.77 X |
| 4,317,016 | 2/1982 | Ito . | |
| 4,338,503 | 7/1982 | Ito et al. | 363/97 X |

FOREIGN PATENT DOCUMENTS

| | | |
|---|---|---|
| 52-96439 | 8/1977 | Japan . |
| 52-96442 | 8/1977 | Japan . |
| 52-96440 | 8/1977 | Japan . |

*Primary Examiner*—Roy N. Envall, Jr.
*Assistant Examiner*—M. M. Lateef
*Attorney, Agent, or Firm*—Schwartz, Jeffery, Schwaab, Mack, Blumenthal & Evans

[57] ABSTRACT

An inductive heating apparatus with multiple high frequency energy source. The apparatus includes plural resonant circuits each having an inductive heating coil and plural drive circuits for driving the resonant circuits. Switch circuits enable energization of one or more of the plural resonance circuits and a logic circuit is provided to ensure that whenever two or more resonance circuits are operated, they will operate at the same frequency to prevent unwanted noise otherwise resulting from the circuits operating at different frequencies.

10 Claims, 4 Drawing Figures

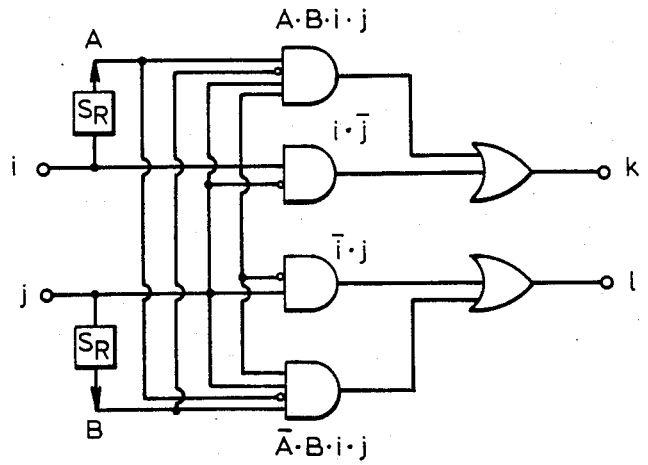
FIG. 3
FIG. 4
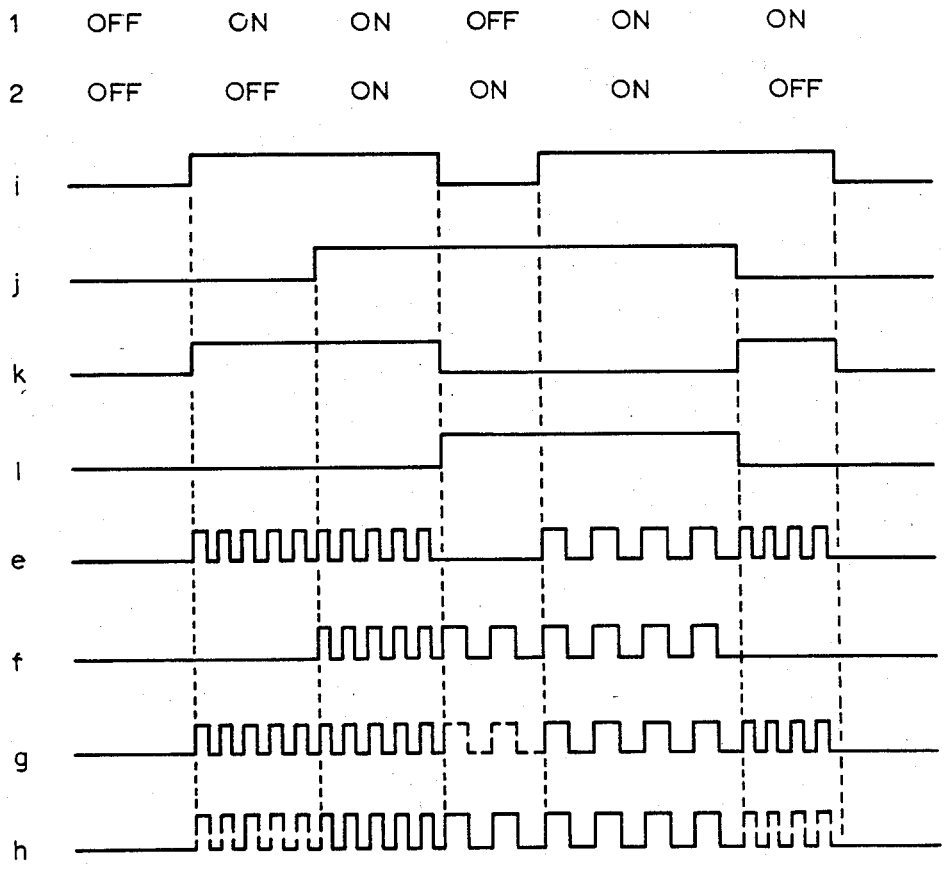

CIRCUIT FOR INDUCTIVE HEATING APPARATUS WITH MULTIPLE HIGH FREQUENCY ENERGY SOURCES

BACKGROUND OF THE INVENTION

The present invention relates to an inductive heating apparatus, and more particularly to an inductive heating apparatus with multiple high frequency energy sources for heating loads.

The conventional inductive heating apparatus, shown in U.S. Pat. No. 4,338,503, includes a pair of on-off switching means to operate a resonant circuit. Therefore, in the case of an inductive heating apparatus with multiple high frequency energy sources, the construction as taught in the above referenced patent is complicated and expensive because of the need for multiple pairs of switches. Thus, it is desirable to provide an induction heating apparatus which is simple and less costly and having fewer switches than in the prior art.

Recently, a desirable type of inductive heating apparatus is available, such as Toshiba Inductive Heater model MR-105 shown in Toshiba Review Vol. 38, No. 2, 1983.

This type of inductive heating apparatus, having an inverter of a single-end type, has a resonant circuit which includes an inductive heating coil a capacitor connected in series to the coil, and a switching means connected in parallel to the capacitor.

The resonant frequency is determined by the condition and size of the load which is inductively coupled the coil, because the resonant circuit resonates in series between the coil and the capacitor.

However, in the inductive heating apparatus with multiple high frequency energy sources of the above type, the resonant frequency may be different for the different sources. If the difference of frequency is larger than 3 KHz for example, there is a problem that noise sounds occurs when the multiple high frequency energy sources are operated at the same time.

A multiple coil prior art inductive heating apparatus is illustrated by U.S. Pat. No. 4,092,510. In this reference, however, multiple heating coils are supplied from a common source to suppress noise interference.

SUMMARY OF THE INVENTION

It is a primary object of the present invention to provide an inductive heating apparatus with multiple high frequency energy sources and resonance circuits for heating multiple loads, wherein when plural resonant circuits are operated simultaneously, they are operated at the same frequency for preventing undesirable noise.

It is another object of the invention to provide a control means for producing control pulse signals according to operating-order conditions of operating switches controlling multiple energy sources in an inductive heating apparatus.

It is a further object of the invention to provide an inductive heating apparatus having multiple high frequency energy sources and multiple loads which uses a logic means for producing trigger pulses having the same frequency even if plural operating switches controlling the multiple energy sources are operated.

The circuit for the inductive heating apparatus of the present invention comprises plural resonant circuits including an inductive heating coil, a capacitor connecting in series with the coil, and an on-off switching device connecting in parallel with the capacitor. The circuit further comprises plural trigger circuits for detecting a resonant current through the coil and for generating trigger pulses respectively, a control means for producing control pulse signals according to operating-order conditions of individual operating switches for the resonant circuits, a logic means for producing the trigger pulses at a common frequency even if the plural operating switches are operated, and plural drive circuits for operating the on-off switching devices respectively.

BRIEF DESCRIPTION OF THE DRAWINGS

Features of the present invention will be apparent from the following drawings, wherein:

FIG. 3 is a block diagram of an embodiment of a control means for an inductive heating apparatus shown in FIG. 1; and FIG. 4 is a graph showing various waveforms for describing the operation of the control means and the logic circuit for the inductive heating apparatus shown in FIG. 1.

DETAILED DESCRIPTION OF THE PREFERRED EMBODIMENT

Figure 1:
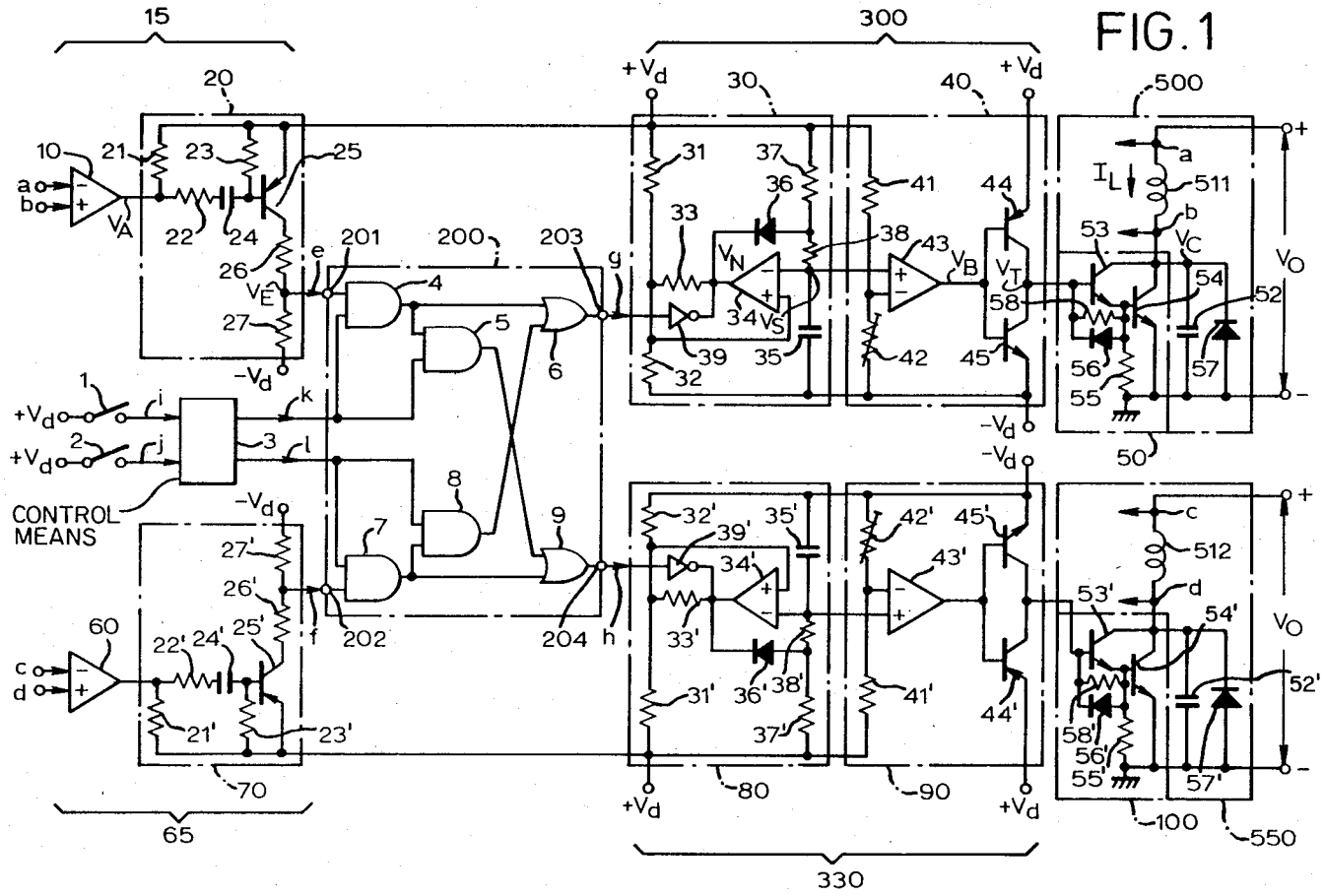
FIG. 1 is a circuit diagram of an embodiment of the present invention.

A first preferred embodiment of the present invention is shown in FIG. 1. The inductive heating apparatus is shown to have first and second high frequency heating circuits represented respectively by elements 10, 20, 30, 40, 500 and elements 60, 70, 80, 90, 550. An inductive heating coil 511 is associated with the first heating circuit, and an inductive heating coil 512 is associated with the second heating circuit. Each of the coils 511 and 512 is operable to generate a high frequency electromagnetic field which is used to heat a magnetic load, such as a pan containing, for example, food products. The coils 511 and 512 are part of resonance circuits having a resonant frequency determined by the load characteristics. Although FIG. 1 shows only two coils and two high frequency heating circuits, it is understood that more than two coils may be provided each associated with a separate high frequency heating circuit.

The first high frequency heating circuit is seen to comprise a trigger circuit 15 which includes an operational amplifier 10 differential circuit 20. Operational amplifier 10 detects the resonant current $I_L$ passing through the coil 511 and generates an output voltage $V_A$ is fed to the differential circuit 20. Differential circuit 20 includes resistors 21, 22, 23, 26 and 27, capacitor 24. Transistor 25 generates an output voltage $V_E$ serving as a trigger signal.

A drive circuit 300 is also provided and comprises a signal generating circuit 30 and switch operating circuit 40. Signal generating circuit 30 includes resistors 31, 32, 33, 37, 38, an operational amplifier 34, a condensor 35, a diode 36 and an inverter 39. The signal generating circuit 30 provides an integration of the incoming trigger signal to produce a saw-tooth voltage signal $V_s$ in response to the input signal. The switch operating circuit 40 includes a resistor 41, a variable resistor 42, an operational amplifier 43, a p-n-p transistor 44 and a n-p-n transistor 45 to produce an actuating pulse signal $V_T$ for resonant circuit 500 in response to the output signal of the signal generating circuit 30.

Resonant circuit 500 is used to heat the first magnetic load. Resonant circuit 500 includes the inductive heating coil 511, a capacitor 52 connected in series to the coil, a diode 57, and a on-off switching device 50 connected in parallel with the capacitor 52 to form a series-resonant circuit between the coil and the capacitor. Switching device 50 further includes resistors 55, 58, a diode 56 and n-p-n transistors 53, 54 connected as a Darlington pair. The switching device 50 is operated to repeatedly turn-on and off in response to pulse signals from the switch operating circuit 40 to repeatedly charge and discharge capacitor 52. As a result, a high frequency resonant current flows through the coil 511 to produce a high frequency magnetic field.

Figure 2:
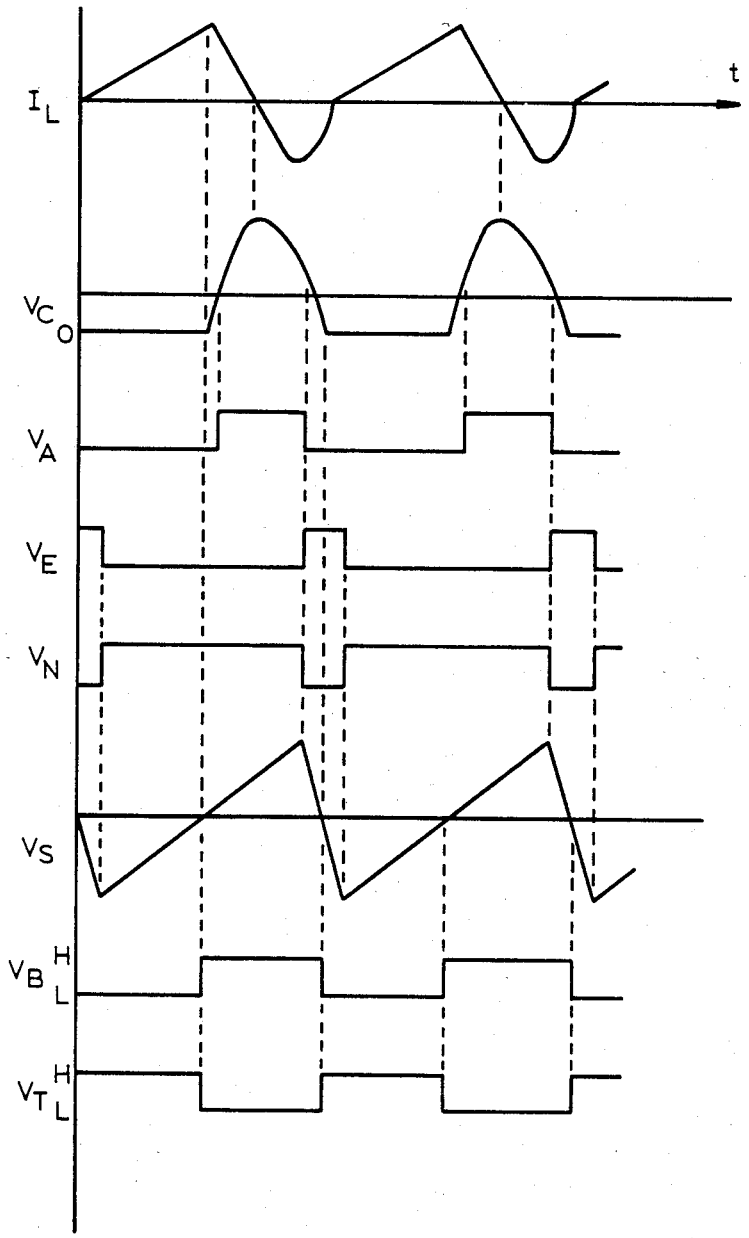
FIG. 2 is a graph showing various waveforms for describing the operation of the embodiment shown in FIG. 1.

The charging and discharging of capacitor 52 is also illustrated in FIG. 2 wherein the waveform $V_C$ is plotted adjacent the waveform for the current $I_L$ in coil 511. FIG. 2 also illustrates the waveforms of the voltages $V_E$, $V_N$, $V_S$, $V_B$ and $V_T$ at correspondingly labeled points in the schematic of FIG. 1. It is noted that the end terminals of the coil 511 are label a, b and that these terminal points are connected as inputs to the trigger circuit 15 and particularly to the operational amplifier 10. The output of the operational amplifier 10 produces a voltage $V_A$ which is seen in FIG. 2 to make transitions at the cross over point of the capacitor voltage waveform $V_C$ with respect to a reference level. Disregarding, for the moment, circuit element 200, the trigger signal $V_E$ is fed to signal generating circuit 30 where it is inverted to produce the voltage waveform $V_N$. A saw-tooth voltage waveform $V_S$ is produced at the output of the signal generating circuit 30 which has ramp-up and ramp-down times correlated to the transitions of waveform $V_N$. The output waveforms $V_B$ and $V_T$ of the switch operating circuit 40 have transitions correlated with the zero crossings of the saw-tooth waveform $V_S$ which in turn is synchronized with the transition to and from the zero level voltage of the capacitor voltage waveform $V_C$. The output of switch operating circuit 40 provides the switching signal to the on-off switching device 50. It may thus be seen that a feedback circuit is provided such that the resonant frequency of coil 511 is synchronized with the trigger signal voltage $V_E$.

The above described high frequency heating circuit, (without circuits 3 and 200 to be described hereinafter) is similar in overall function and operation to circuits such as those illustrated in U.S. Pat. No. 4,115,676, incorporated herein by reference. These circuits, as well as FIG. 1, utilize a switching element in series with the heating coil and a capacitor and diode connected in parallel to form a circuit known as a single-end type inverter circuit. U.S. Pat. No. 4,317,016 shows a similar arrangement.

Not illustrated in FIG. 1 are the AC source and conventional rectifier circuits used to generate DC voltages such as load voltage $V_O$ and the biasing voltages $+V_d$, $-V_d$ shown in FIG. 1.

A second high frequency energy source is also shown in FIG. 1 and is seen to comprise an operational amplifier 60, differential circuit 70, signal generating circuit 80 and switch operating circuit 90. These elements are composed of identical components as in the previously described first high frequency energy source, and the elements are also identically interconnected with one another as in the first high frequency energy source.

Manually operable switches 1 and 2 provide sequence operating signals i,j in order to actuate the first and second high frequency energy sources respectively. A control means 3 is provided to generate control pulse signals k,l in response to the actuation of switches 1 and 2 respectively.

The control means 3, may comprise, for example, a plurality of logic gate-circuits as shown in FIG. 3. FIG. 3 illustrates four AND gates, two OR gates, and two shift resistors, SR, which respectively produces pulse signals for the AND gates.

Input signals of the control means 3, termed sequence operating signals i,j, are respectively produced by the manual switches 1,2. The control pulse signals k,l are produced in response to the operating-order of the signals i,j, as shown in FIG. 4.

From a review of FIGS. 3 and 4 it may be seen that the shift registers may comprise two-stage shift registers which each shift the state data therein by one register whenever either an i or j signal changes state. Thus, just after a transition of either signal i or j, the output of the shift register A,B is such as to be representative of the logic state of i,j just prior to the transition. Such a construction produces the outputs for the control pulse signals as indicated in FIG. 4.

The implementation shown in FIG. 3 for the control means 3 may be replaced by a programmed digital computer operable to provide the signals shown in FIG. 4. A microcomputer implementation may be especially advantageous where control of other aspects of the induction heating are desirable including operator interfacing.

Interposed between the trigger circuits 15 and 65 and the respective drive circuits 300 and 330, is a logic circuit 200. The logic circuit 200 also consists of logic-gate-circuits. As shown in FIG. 1, logic circuit 200 includes AND gates 4, 5, 7 and 8 and OR gates 6 and 9. One input terminal of AND gates 4 and 7 are connected to respective differential circuits 20 and 70, and the other terminal is connected to control means 3. One input terminal of AND gates 5,8 is connected to the outputs of AND qates 4,7 respectively, and the other input terminal of each gate is connected to control means 3. One input terminal of the OR gates 6,9 is respectively connected to the outputs of AND gates 8,5, and the other terminal is respectively connected to the outputs of AND qates 4,7.

In operation, referring to FIG. 4, magnetic loads (not shown) are respectively coupled with the coils 511 and 512 in the first and the second high frequency energy sources. The operating switch 1 is turned on to operate amplifier 10, differential circuit 20, drive circuit 300, and resonant circuit 500. The resonant current $I_L$ flows through coil 511, and the magnetic load coupled to coil 511 is heated by the high frequency magnetic field.

In this case, the resonant frequency of the high frequency magnetic field is determined according to particular characteristics of the load. The trigger circuit 15 generates the trigger pulses $V_E$ (FIG. 2) in response to the resonant frequency through the amplifier 10. This pulse $V_E$ is also shown in FIG. 4 as trigger signal e. As the signal i is "high" and the signal j is "low", the control pulse signal k is "high," and signal 1 is "low". Accordingly, the trigger pulses g,h are synchronized with trigger signal e. The first resonant circuit 500 is operated in accordance with the signal $V_E$, namely, at the resonant frequency determined by the condition of the load coupled with coil 511.

When the operating switch 2 is turned on, operational amplifier 60, differential circuit 70, drive circuit 330 and the second resonant circuit 550 start to operate. Resonant current flows through the coil 512 to heat the magnetic load coupled with the coil 512. At this time, in spite of the fact that signal j is "high" because switch 2 is turned on, the control means 3 does not change the output signals k,l, but maintains them as shown in FIG. 4. Therefore, trigger pulses g,h are still snychronized with the output signal $V_E$ of trigger circuit 15. As a result, the resonant frequency in resonant circuit 550 is forcibly synchronized with the resonant frequency in resonant circuit 500. Thus, both resonance circuits 500 and 550 are operated at the same frequency.

If, during the operation of resonant circuits 500, 550, the operating switch 1 is turned off, the resonant circuit 500 stops operating. The sequence operating signal i changes to "low". At this time, since j is "high", and the control means 3 changes signal k and 1 to "low" and "high" respectively. Accordingly, the trigger pulses g,h are synchronized with trigger pulse f at the output of trigger circuit 65. The second resonant circuit 550 now operates at resonant frequency determined by the condition of the load coupled with coil 512. Typically, the resonant frequency will be different as indicated in FIG. 4 because of different load characteristics.

Switch 1 may now be turned on to operate resonant circuit 500 during operation of resonant circuit 550. Then, signals i,j are both "high". Control means 3 again does not change the state of signals k,l and produces the same signals k,l as before. Thus, trigger pulses g,h are now both synchronized with signal f, so that the resonant frequency of circuit 500 is forcibly synchronized with the resonant frequency of circuit 550.

In summary, control means 3 produces the control pulse signals k,l in response to the condition of the operating switches 1,2. The logic circuit 200 forcibly synchronizes trigger signal g with trigger signal h according to control pulse signals k,l, and produces signals of the same frequency.

In a broader aspect of the invention, control means 3 and logic circuit 200 may be looked upon as a circuit means (even assuming control means 3 is computer implemented) which generates a first trigger signal g to the first drive circuit 300 and a second trigger signal h to the second drive circuit 330. The resonant circuits 500 and 550 operate at a frequency synchronized with the first and second trigger signals respectively. Trigger circuit 15 may be considered a first trigger circuit producing a third trigger signal e at its output, and trigger circuit 65 may be considered a second trigger circuit producing a fourth trigger signal f at its output. The output of control means 3 may be considerd to produce first and second control signals k and l respectively. When only the first high frequency energy circuit is operated via the switches 1 and 2, only the first trigger signal g is generated at both outputs of the logic circuit 200, and this first trigger signal is synchronized with the third trigger signal from the trigger circuit 15 and thus synchronized with the natural, load-dependent, resonant frequency of the resonant circuit 500. Similarly, if only the second high frequency energy circuit is operated, only the second trigger signal h is generated at both outputs of logic circuit 200, and this second trigger signal is synchronized with the fourth trigger signal from the trigger circuit 65 and thus synchronized with the natural, load-dependent, resonant frequency of the resonant circuit 550. Whenever both high frequency energy circuits are operated sequentially, the circuits force the second actuated high frequency energy circuit to operate at the same resonant frequency as the first actuated high frequency energy circuit so as to eliminate noise effects produced from interference between the different frequencies of the circuits produced when different loads are coupled to the heating coils 511 and 512.

While the invention has been described in reference to a prefered embodiment, it will be understood by those skilled in the art that various modifications may be made without departing from the spirit and scope of the invention as set forth in the appended claims.

What is claimed is:

1. A circuit for an inductive heating apparatus with multiple high frequency energy sources comprising:

(a) plural resonant circuit means, each including an inductive heating coil coupled with a magnetic load, a capacitor connected in series to said coil, and an on-off switching device connected in parallel to said capacitor, for generating high frequency signals respectively;

(b) a plurality of trigger circuit means, one trigger circuit means associated with each resonant circuit for detecting resonant current through an associated coil and for generating trigger pulses in response to said resonant current;

(c) a control means, including plural input terminals connecting to operating switches, and output terminals, for producing control pulse signals according to an operating-sequence of said operating switches for actuating said resonant circuits;

(d) a logic circuit means, connected to said plurality of trigger circuit means and said control means, for producing the same trigger signal to plural output terminals thereof in response, at least in part, to said control pulse signals; and (e) a plurality of drive circuit means, one drive circuit means connected to each of the output terminals of said logic circuit means, for operating said on-off switching devices so that said plural resonant circuit means operate at the same high frequency.

2. A circuit for an inductive heating apparatus according to claim 1, wherein each of said trigger circuit means further comprises:

an operational amplifier for detecting said resonant current through said coil; and a differential circuit for generating said trigger pulses in response to an output of said operational amplifier.

3. A circuit for an inductive heating apparatus according to claim 1, wherein each of said drive circuit means further comprises:

a signal generating circuit, connected to the output terminal of said logic circuit means, for producing saw-tooth waveform signals in response to the trigger signals of said logic circuit means; and a switch operating circuit, connected in series with said signal generating circuit for producing signals to actuate said associated switching device in response to said saw-tooth waveform signals.

4. A circuit for an inductive heating apparatus according to claim 1, wherein said control means produces first control pulse signals in response to a first actuated one of said operating switches and produces only said first control pulse signals unless the first operating switch is reset even if other operating switches are actuated, said logic circuit means producing multiple trigger signals of the same frequency in response to said first control pulse signals.

5. A circuit for an inductive heating apparatus according to claim 1, wherein said logic circuit means comprises logic gate circuits.

6. A circuit for an inductive heating apparatus comprising:

(a) a first high frequency energy circuit including:
  (1) a first resonant circuit having an inductive heating coil for coupling to a first load, and
  (2) a first drive circuit connected to drive said first resonant circuit in response to a first trigger signal, (b) a second high frequency energy circuit including:
  (1) a second resonant circuit having an inductive heating coil for coupling to a second load, and
  (2) a second drive circuit connected to drive said second resonant circuit in response to a second trigger signal, (c) first and second switches connected to operate said first and second high frequency energy circuits, (d) circuit means responsive at least to said first and second switches and providing said first and second trigger signals, and (e) said circuit means operable for:
  (1) generating said first and second trigger signals having the same frequency whenever both said first and second switches operate said first and second high frequency energy circuits,
  (2) generating only said first trigger signal whenever only said first switch operates only said first high frequency energy circuit, and
  (3) generating only said second trigger signal whenever only said second switch operates only said second high frequency energy circuit, said first and second trigger signals having first and second, separate, load-dependent frequencies whenever only said first switch and only said second switch are operated, whereby unwanted noise produced when said first and second high frequency energy circuits are operated at different frequencies at the same time is eliminated by forcing said first and second resonant circuits to operate at the same frequency whenever said first and second high frequency energy circuits are operated together.

7. A circuit for an inductive heating apparatus according to claim 6, wherein said first resonant circuit includes a first switching device controlled by said first drive circuit, a first capacitor connected in parallel with said first switching device and a first diode connected in parallel with said first switching device, and said second resonant circuit includes a second switching device controlled by said second drive circuit, a second capacitor connected in parallel with said second switching device and a second diode connected in parallel with said second switching device.

8. A circuit for an inductive heating apparatus according to claim 6 wherein:

(1) said first high frequency energy circuit further includes a first trigger circuit responsive to the resonant frequency of said first resonant circuit for generating a third trigger signal synchronized therewith, (2) said second high frequency energy circuit further includes a second trigger circuit responsive to the resonant frequency of said second resonant circuit for generating a fourth trigger signal synchronized therewith, and (3) said circuit means is further responsive to said third or fourth trigger signals and operable for generating said first trigger signal in synchronism with said third trigger signal whenever only said first switch operates only said first high frequency energy circuit and operable for generating said second trigger signal in synchronism with said fourth trigger signal whenever only said second switch operates only said second high frequency energy circuit.

9. A circuit for an inductive heating apparatus according to claim 7 wherein:

(1) said first high frequency energy circuit further includes a first trigger circuit responsive to the resonant frequency of said first resonant circuit for generating a third trigger signal synchronized therewith, (2) said second high frequency energy circuit further includes a second trigger circuit responsive to the resonant frequency of said second resonant circuit for generating a fourth trigger signal synchronized therewith, and (3) said circuit means is further responsive to said third or fourth trigger signals and operable for generating said first trigger signal in synchronism with said third trigger signal whenever only said first switch operates only said first high frequency energy circuit and operable for generating said second trigqer signal in synchronism with said fourth trigger signal whenever only said second switch operates only said second high frequency energy circuit.

10. A circuit for an inductive heating apparatus according to claim 8 wherein said circuit means includes:

(a) a control means responsive to said first and second switches for providing first and second control signals, and (b) logic circuit means connected to receive said third and fourth trigger signals and said first and second control signals for generating said first and second trigger signals.

* * * * *